US010134310B2

(12) United States Patent
Roberts et al.

(10) Patent No.: US 10,134,310 B2
(45) **Date of Patent: *Nov. 20, 2018**

(54) CURRENT-GENERATED PHOTO-LUMINESCENT HYBRID SIGN

(71) Applicant: GLOW LIGHT EMERGENCY EXIT PRODUCTS, LLC, Cincinnati, OH (US)

(72) Inventors: O. Michael Roberts, Blacklick, OH (US); Thomas Wells Brignall, Jr., Marcellus, MI (US)

(73) Assignee: GLOW LIGHT EMERGENCY EXIT PRODUCTS, LLC, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,077

(22) Filed: Dec. 20, 2017

(65) Prior Publication Data

US 2018/0114472 A1 Apr. 26, 2018

Related U.S. Application Data

(63) Continuation of application No. 13/276,452, filed on Oct. 19, 2011, now Pat. No. 9,852,667.

(60) Provisional application No. 61/344,881, filed on Nov. 2, 2010.

(51) Int. Cl.

| | |
|---|---|
| ***G09F 3/20*** | (2006.01) |
| ***G09F 13/18*** | (2006.01) |
| ***G09F 13/20*** | (2006.01) |
| ***G09F 19/22*** | (2006.01) |
| *F21V 9/30* | (2018.01) |

(52) U.S. Cl.
CPC ..... *G09F 13/18* (2013.01); *G09F 13/20* (2013.01); *G09F 19/22* (2013.01); *F21V 9/30* (2018.02)

(58) Field of Classification Search
CPC ..... G09F 3/20; F21V 9/16
USPC ..... 40/542, 570, 572, 573, 582, 583, 564
See application file for complete search history.

(56) References Cited

U.S. PATENT DOCUMENTS

| | | | |
|---|---|---|---|
| 1,725,206 | A | 8/1929 | Petersen |
| 2,509,707 | A | 5/1950 | Taylor |
| 3,038,271 | A | 6/1962 | MacHutchin et al. |
| 3,780,462 | A | 12/1973 | Pregel et al. |
| 4,424,449 | A | 1/1984 | O'Brill |
| 5,027,258 | A | 6/1991 | Schöniger et al. |
| 5,279,058 | A | 1/1994 | Kohn |
| 5,457,615 | A | 10/1995 | Nezer |
| 5,485,145 | A | 1/1996 | Sniff |
| 5,607,222 | A | 3/1997 | Woog |
| 6,364,498 | B1 | 4/2002 | Burbank |
| 6,843,010 | B2 | 1/2005 | Robinson et al. |
| 7,114,840 | B2 | 10/2006 | Hamrick |
| 7,241,021 | B2 | 7/2007 | Hannington |
| 7,412,790 | B2 | 8/2008 | Riopel et al. |
| 7,559,664 | B1 | 7/2009 | Walleman et al. |
| 7,937,865 | B2 | 5/2011 | Li et al. |
| 2004/0184259 | A1 | 9/2004 | To |
| 2005/0198879 | A1 | 9/2005 | Hannington |

(Continued)

*Primary Examiner* — Syed A Islam
(74) *Attorney, Agent, or Firm* — Flynn, Thiel, Boutell & Tanis, P.C.

(57) ABSTRACT

A current-generated photo-luminescent hybrid sign is provided that includes one or more light emitting elements within a channel in the frame to evenly distribute light, while at the same time energizing a photo-luminescent glow material in case of power outage. A method of use of the sign is also provided.

20 Claims, 7 Drawing Sheets

(56) References Cited

U.S. PATENT DOCUMENTS

| | | | |
|---|---|---|---|
| 2006/0016109 | A1 | 1/2006 | Nicolaas |
| 2006/0225326 | A1 | 10/2006 | Robinson et al. |

CURRENT-GENERATED PHOTO-LUMINESCENT HYBRID SIGN

CROSS-REFERENCE TO RELATED APPLICATIONS

This is a continuation of prior U.S. application Ser. No. 13/276,452, filed Oct. 19, 2011, which claims the benefit of U.S. Provisional Application No. 61/344,881, filed Nov. 2, 2010, the disclosure of which is hereby incorporated by reference in its entirety.

BACKGROUND OF THE INVENTION

The present invention relates to hybrid photo-luminescent signs, and more particularly to electrical signs with non-electric photo-luminescent backup.

Standard electric signs, such as exit signs, require 3 to 5 watts of energy and may operate on a battery backup when there is an electricity outage. However, such battery backups can be unreliable and battery replacement is often forgotten. Moreover, many of these signs use lamps that last for only a short period of time, such as 3 to 6 months.

Even newer signs with lamps that last longer, such as light emitting diodes (LEDs) that last up to 10 years, will not qualify for certain safety standards such as UL Laboratories Standard No. 924. Such signs do not emit enough light to be seen at 100 feet upon power outage.

The current-generated photo-luminescent hybrid sign of the present invention preferably does not include a battery backup but provides a luminescent sign even during a power outage, passes rigorous safety standards, and can be seen 100 feet away.

An embodiment of the present invention includes hybrid a photo-luminescent sign of that uses electricity-powered LED lights that illuminate the sign internally, and in turn energize a photo-luminescent portion or portions that illuminate the sign in case of power outage. The photo-luminescent portions are preferably formed by a molded photo-luminescent sheet and a front plate with apertures to define the characters. The characters may also be screen printed. A power converter step-down unit is also included that is capable of automatically stepping down electricity voltage from either 277 volts or 120 volts to 12 volts. The sign also includes a frame with a channel therein for housing an elongated board of LED lights. The channel is preferably narrowed as it extends inwardly to better focus the light emitted from the LEDs for a more even light output.

Other advantages, objects and/or purposes of the invention will be apparent to persons familiar with constructions of this general type upon reading the following specification and inspecting the accompanying drawings.

BRIEF DESCRIPTION OF THE DRAWING FIGURES

DETAILED DESCRIPTION OF THE PREFERRED EMBODIMENT

Figure 1:
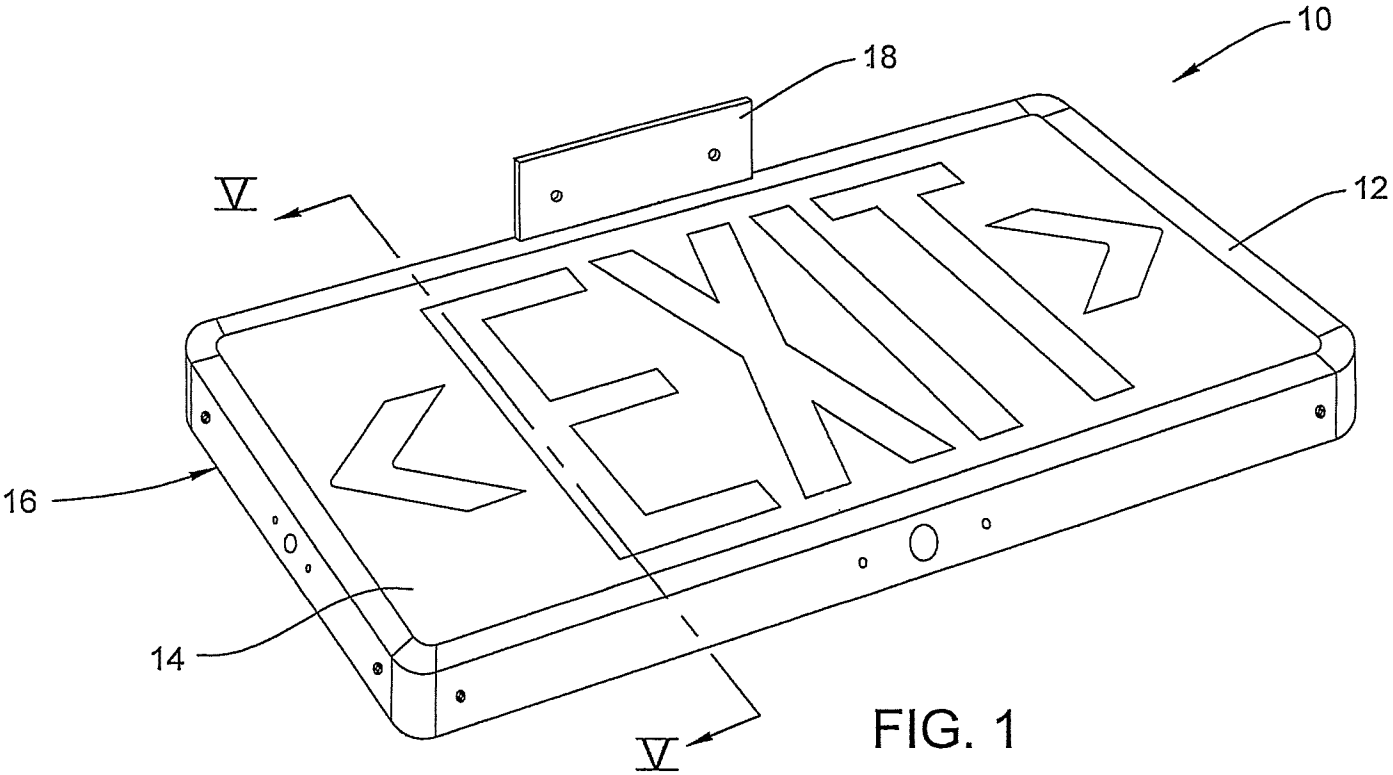
FIG. 1 is a front perspective view of a hybrid photo-luminescent sign of the present invention.

Certain terminology will be used in the following description for convenience and reference only and will not be limiting. The words "up," "down," "left," and "right" will designate directions in the drawings to which reference is made. The words "front" and "rear" will designate the front of the sign facing the reader in FIG. 1 and the other directions will follow accordingly. Such terminology will include derivatives and words of similar import.

FIG. 1 shows a hybrid current-generated photo-luminescent sign 10 that generally includes a frame 12, a front face plate 14, a rear plate 16, and a mounting bracket 18. The sign 10 also generally includes a light source 20 and a power converter 22 (see FIG. 2).

Figure 2:
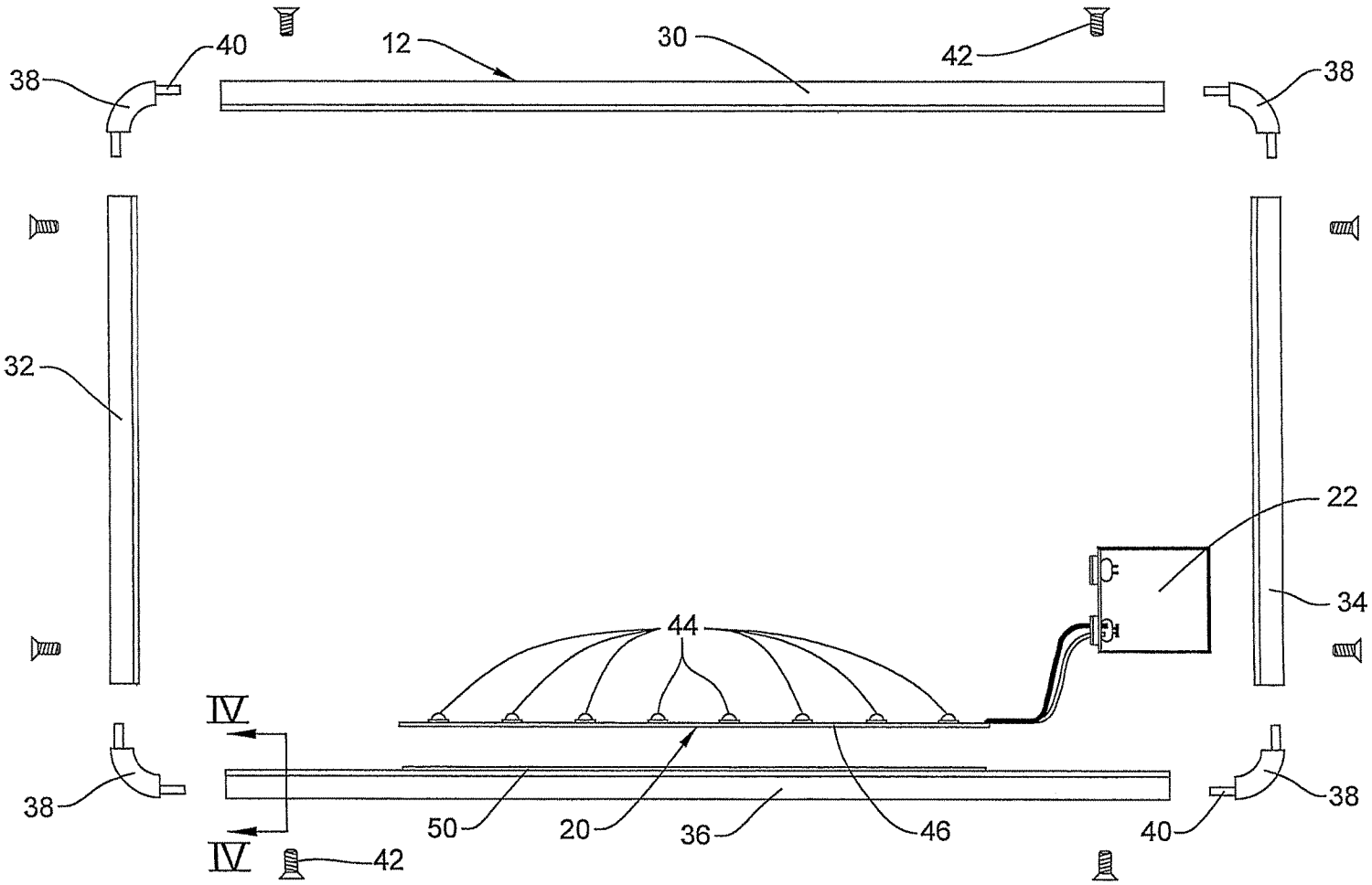
FIG. 2 is an elevational exploded view of the frame and light strip of the sign of FIG. 1.

FIG. 2 shows the frame 12 in an exploded view, along with the light source 20 and the power converter 22, which reside interiorly of frame 12. The frame 12 includes a top rail 30, a left rail 32, a right rail 34, and a bottom rail 36. The rails are attached to one another by curved corner pieces 38, which each include legs 40 for secure attachment to the lengthwise rails by fasteners such as screws 42. The frame 12 is preferably made of extruded aluminum with cast aluminum corners 38. The bottom rail 36 includes a central channel structure 50 defining a channel 52, which is shown in detail in FIG. 4 and described in more detail below.

Light source 20 preferably includes a plurality of light emitting elements 44 which are aligned equidistantly along an elongated circuit board 46. Light emitting elements 44 are preferably light emitting diodes (LEDs) and most preferred are 240 degree lamps. For a standard exit sign, eight aligned LEDs are preferred, but more or less may be used, depending on the desired light output, and size and shape of the sign. The board 46 preferably draws 0.24 amps at 2.88 watts of power. The board is driven at 80% power capacity, which results in a reduced heat build-up and increases the life expectancy of the entire light source 20. The sign 10, in turn, operates on between 0.5 and 1.0 watts of power.

Figure 3A:
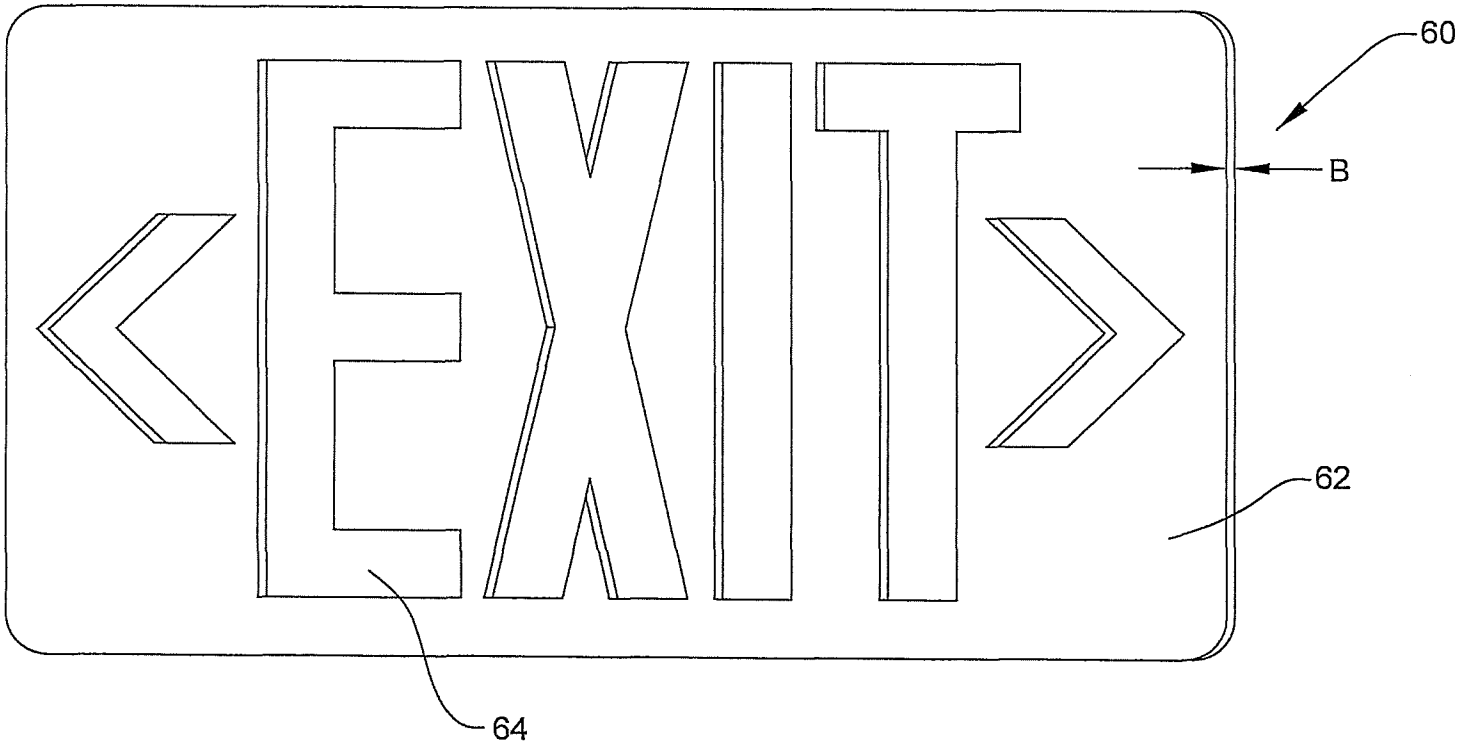
FIG. 3A is an elevational view of an outer part of a front face panel of the sign of FIG. 1.
Figure 3B:
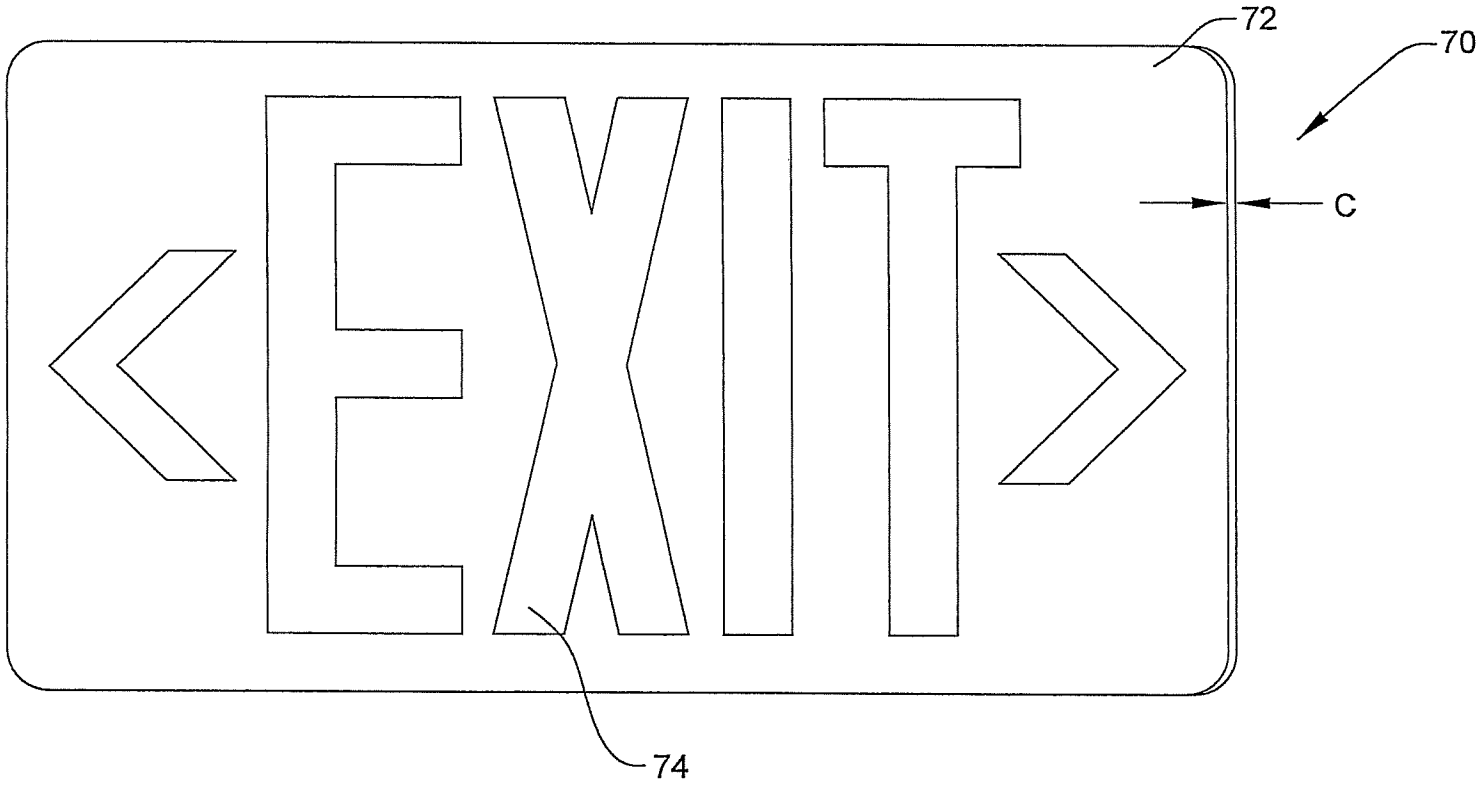
FIG. 3B is an elevational view of a first embodiment of an inner part of a front face panel of the sign of FIG. 1.
Figure 3C:
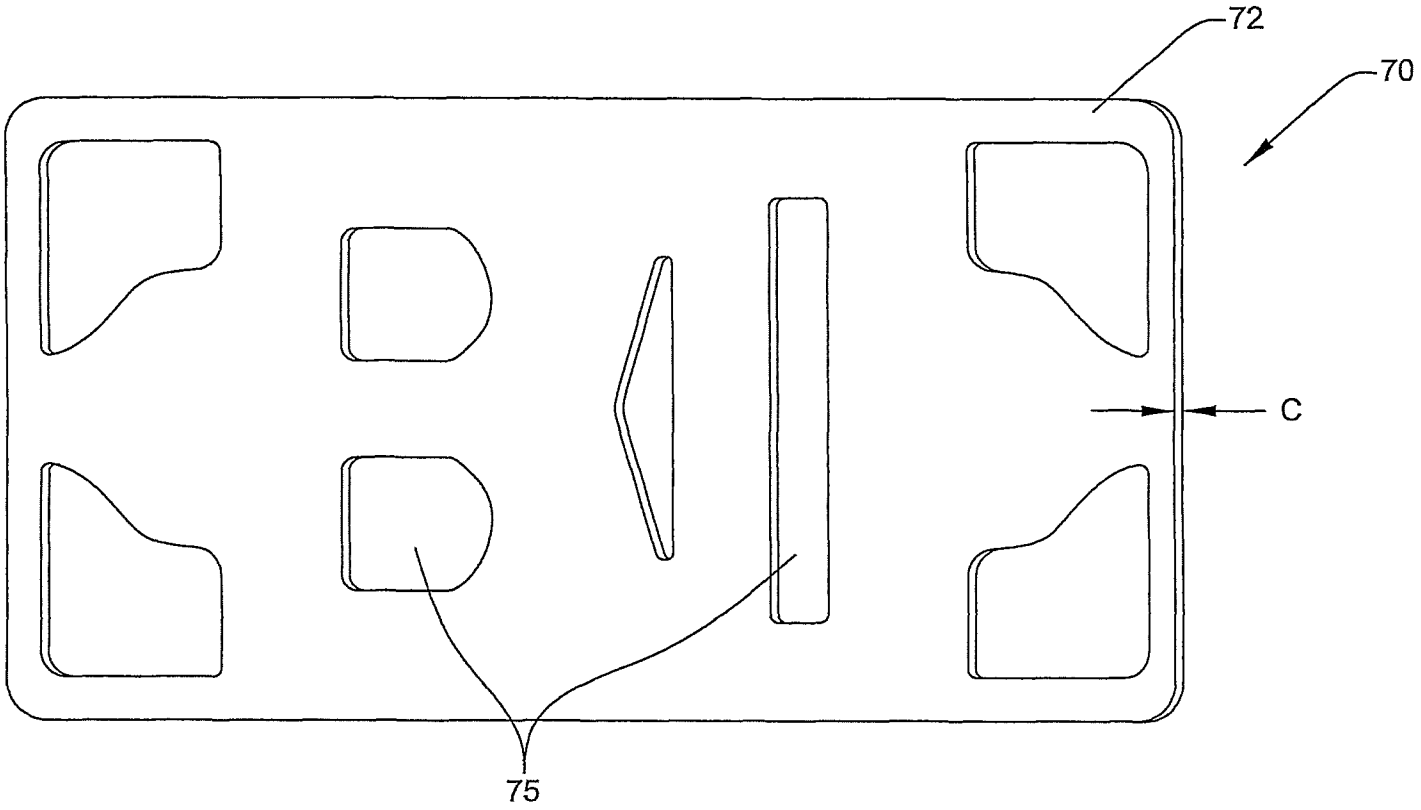
FIG. 3C is an elevational view of a second embodiment of an inner part of a front face panel of the sign of FIG. 1.

FIG. 3A shows a first component of front face plate 14. FIGS. 3B and 3C show two alternatives of a second component of front face plate 14. Shown in FIG. 3A is an outer cover plate 60. Outer cover plate 60 is preferably made of a sturdy metal material such as aluminum, and has a thickness designated as "B" in FIG. 3A. The outer cover plate 60 includes a face 62 and character apertures 64 which are formed by water jet cutting, stamping, routing, or another method, followed by deburring of the edges. Thickness "B" may be any suitable thickness, but is preferred to be 0.04 inches if outer cover plate 60 is of aluminum.

FIG. 3B depicts a second component of a front face plate 14, which is an inner cover plate 70. Inner cover plate 70 has a face 72 and a thickness designated by the letter "C" in FIG. 3B. The thickness "C" is large enough that the inner cover plate 70 is substantially rigid but thin enough to fit within the confines of the frame 12 and to allow light therethrough. On face 72 are characters 74, which are of a photo-luminescent material, preferably strontium aluminum oxide. A suitable strontium aluminum oxide is model GLL300E manufactured and sold by Nemoto Shenzhen Limited of Tokyo, Japan. The GLL300E substance comprises strontium aluminum oxide having a particle size of about 90 microns. A higher particle size is preferable to achieve a quicker charge and a much longer discharge of light in an emergency. The characters 74 are placed on face 72 by any useful means, but preferably by screen printing using known screen printing techniques, and are most preferably screen printed in eight layers. The inner cover plate 70 is preferably of a semi-transparent plastic material that is substantially rigid, and more preferably is 0.060 inch thick polycarbonate resin thermoplastic, such as Lexan®.

In an alternative, and preferred, embodiment of inner cover plate 70 as shown in FIG. 3C, the entire plate is made of a photo-luminescent material. The plate is made of a resilient substance that is energized by exposure to light, preferably a mixture of polypropylene and strontium aluminum oxide, and more preferably a mixture of 60% by weight polypropylene and 40% strontium aluminum oxide which has a particle size of 30-40 microns. A suitable strontium aluminum oxide for this embodiment is model G300M, manufactured and sold by Nemoto Shenzhen Limited of Tokyo, Japan. The polypropylene/strontium aluminum oxide mixture is preferably pelletized and extrusion molded into inner cover plate 70. Using such a mixture, the inner cover plate may be between 0.020 inches to 0.100 inches in thickness, but is preferably between 0.065 inches and 0.070 inches in thickness. The inner cover plate 70 of FIG. 3C may be one solid sheet but because outer cover plate 60 will be used, the inner cover plate 70 may include apertures 75, where the characters of the outer cover plate 60 are not positioned, to decrease the amount of material used.

Figure 4:
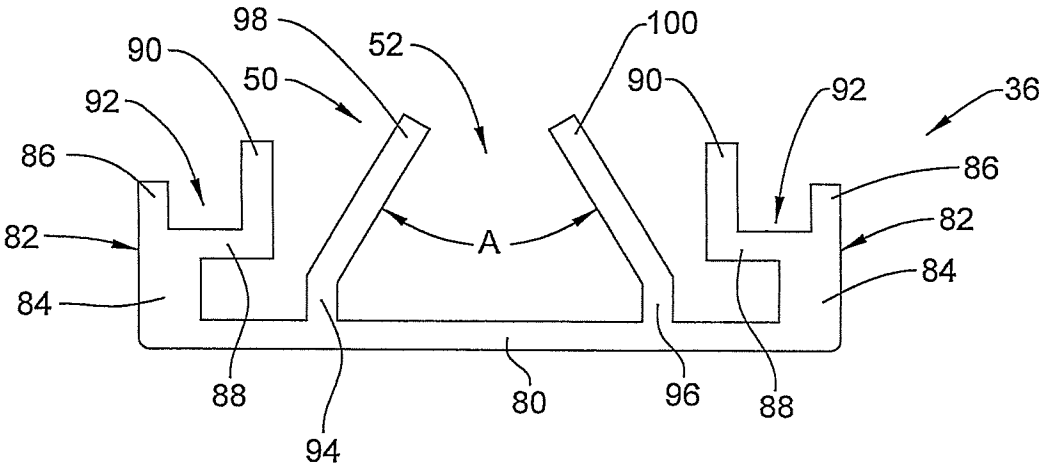
FIG. 4 is a cross-sectional view of the frame taken along line IV-IV in FIG. 2.

FIG. 4 depicts a cross-section of the bottom rail 36 of the frame 12. The bottom rail 36 includes a base 80, two outer holding structures 82, which are mirror-images of each other, and channel structure 50, which is centrally located between outer holding structures 82. Outer holding structures 82 each include an upwardly extending member 84 which is attached to the base 80, a first upward projection 86 which extends upwardly from member 84 and defines the outer periphery of the bottom rail 36. A cantilevered arm 88 extends inwardly from member 84, and a second upward projection 90, which is interior with respect to projection 86, extends upwardly from the cantilevered arm 88. Projection 86, arm 88, and projection 90 together define a groove 92, in which the edges of one or more panels may reside.

Channel structure 50 includes, and thus channel 52 is defined, in part, by a portion of base 80. Extending upwardly from base 80 is a first leg 94 and a second leg 96, which are spaced from each other to create an outer channel width adjacent the base 80. Legs 94 and 96 are generally perpendicular to base 80. Extending inwardly and toward each other from legs 94, 96 are inner members 98, 100. Inner members 98, 100 are preferably straight, but do not need to be. If straight, the inner members 98, 100 are disposed at an angle "A" with respect to one another. The angle "A" is preferably between 50° and 70°, and more preferably 60°. Inner members 98, 100 terminate spaced from one another with an inner width between their ends that is less than the outer channel width between the legs 94, 96. The inner width is preferably between 35% and 40% of the outer width between the legs 94, 96, and is preferably less than 0.25 inches. Base 80; legs 94, 96; and inner members 98, 100 together define channel 52. Channel 52 is sized and shaped to receive board 46 and light emitting elements 44. Channel 52 preferably extends the majority of the length of the bottom rail 36.

Figure 5:
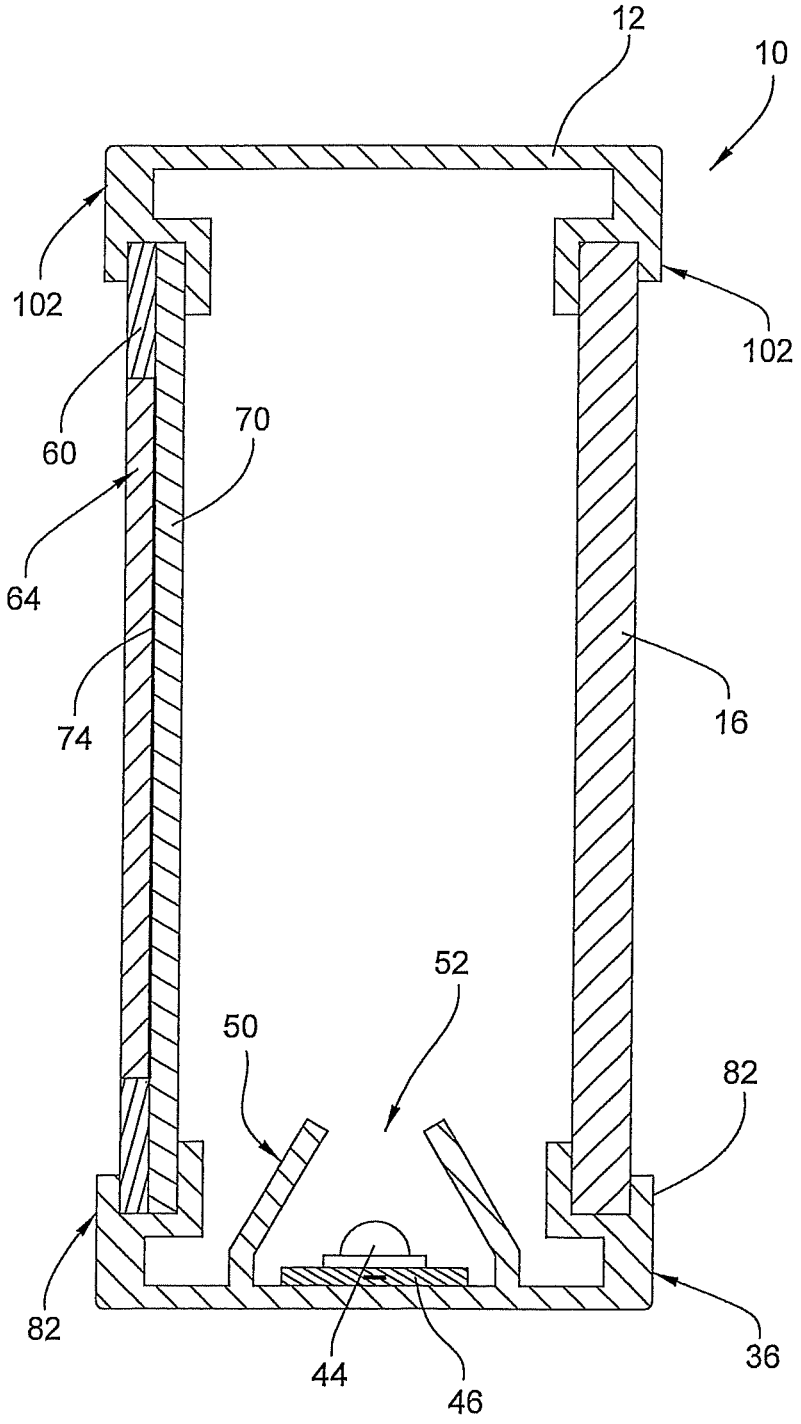
FIG. 5 is a cross sectional view of the sign taken along line V-V in FIG. 1.

FIG. 5 is a cross-section of the current-generated photo-luminescent hybrid sign 10. The top portion of frame 12 includes outer holding structures 102 similar to outer holding structures 82. The outer holding structures 82, 102 retain edges of the outer cover plate 60 and inner cover plate 70 snugly at the front of the sign 10, and the rear plate 16 at the rear of the sign 10. In front face plate 14, photo-luminescent portions of the face 72 align with apertures 64 such that the characters 74 can be seen through the apertures 64. Channel 52 houses board 46 and LEDs 44 such that the light emitted from the LEDs 44 is focused upwardly and lights sign 10 while at the same time energizing characters 74 in case of power outage.

In operation, sign 10 is mounted to a ceiling or wall using mounting bracket 18. The sign 10 is hard wired to the electrical system of the building by extending wires through an aperture (not shown) in the frame 12 to the electrical system of the building. Upon hard wiring to the building electricity source, (which may be 120 volt or 277 volt), the step-down converter 22 converts the voltage to 12 volts and the 12-volt electrical current is transmitted to the board 46, which in turn energizes light emitting elements 44. The light emitting elements 44 light the sign entirely while electricity is being provided to the sign 10. At the same time, light from the light emitting elements 44 is energizing the photo-luminescent portion of the sign in case of power outage. During a power outage, the photo-luminescent portions glow such that the characters 74 of sign 10 can be seen at least 100 feet away from the sign for 90 minutes after the power outage. Thus, the sign 10 meets or exceeds all government energy and environmental building regulations and requirements.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A photo-luminescent sign comprising:

a front panel comprising at least one photo-luminescent member which is energizable by exposure to a light source, the photo-luminescent member comprising a thermoplastic polymer and a photo-luminescent material having an average particle size in the range of about 30 microns to about 40 microns and being capable of emitting light visible by the human eye;

a lengthwise rear panel disposed adjacent to and behind the front panel;

a frame attached to both the front panel and the rear panel, the front panel, rear panel, and frame together defining a housing; and a light source within the housing and positioned adjacent the at least one photo-luminescent member such that the light source may be used to energize at least a portion of the photo-luminescent member;

the photo-luminescent member when energized is seen at least 100 feet away from the sign for at least 90 minutes without the use of electricity.

2. The photo-luminescent sign of claim 1, wherein the photo-luminescent sign does not include a battery.

3. The photo-luminescent sign of claim 1, wherein the photo-luminescent sign is capable of operating on between 0.5 and 1.0 watts of power.

4. The photo-luminescent sign of claim 1, wherein the photo-luminescent material comprises strontium aluminum oxide.

5. The photo-luminescent sign of claim 1, wherein the photo-luminescent member is comprised of a mixture of polypropylene and strontium aluminum oxide.

6. The photo-luminescent sign of claim 1, wherein the light source comprises a plurality of light emitting diodes.

7. The photo-luminescent sign of claim 3, wherein the light source comprises a plurality of light emitting diodes.

8. The photo-luminescent sign of claim 3, wherein the photo-luminescent member is comprised of a mixture of polypropylene and strontium aluminum oxide.

9. The photo-luminescent sign of claim 1, wherein the thermoplastic polymer comprises polypropylene.

10. A photo-luminescent sign comprising:

a housing;

a front panel connected to the housing and comprising a plate, the plate comprising a photo-luminescent material having an average particle size in the range of about 30 microns to about 40 microns and being semi-transparent such that light can pass therethrough; and a light source disposed within the housing and spaced from the plate, the light source disposed to emit light to and through the plate, and to simultaneously energize the photo-luminescent material of the plate, the photo-luminescent material of the plate when energized is seen at least 100 feet away from the sign for at least 90 minutes without the use of electricity.

11. The photo-luminescent sign of claim 10, wherein the photo-luminescent material comprises strontium aluminum oxide.

12. The photo-luminescent sign of claim 10, wherein the photo-luminescent material is comprised of about 40% of a light-energizable substance.

13. The photo-luminescent sign of claim 10, the plate further comprising a thermoplastic.

14. The photo-luminescent sign of claim 13, wherein the thermoplastic comprises polypropylene.

15. A photo-luminescent sign comprising:

a front panel comprising at least one photo-luminescent member which is energizable by exposure to a light source, the photo-luminescent member comprising a photo-luminescent material having an average particle size less than or equal to about 40 microns and being capable of emitting light visible by the human eye;

a lengthwise rear panel disposed adjacent to and behind the front panel;

a frame attached to both the front panel and the rear panel, the front panel, rear panel, and frame together defining a housing;

a light source within the housing and positioned adjacent the at least one photo-luminescent member such that the light source may be used to energize at least a portion of the photo-luminescent member; and a power converter capable of converting both 120-volt electricity and 277-volt electricity to a 12-volt output, the power converter in electrical communication with the light source.

16. The photo-luminescent sign of claim 15, wherein the photo-luminescent sign does not include a battery.

17. The photo-luminescent sign of claim 15, wherein the photo-luminescent member is comprised of a mixture of polypropylene and strontium aluminum oxide.

18. The photo-luminescent sign of claim 15, wherein the light source comprises a plurality of light emitting diodes.

19. A photo-luminescent sign comprising:

a front panel comprising at least one photo-luminescent member which is energizable by exposure to a light source, the photo-luminescent member comprising a photo-luminescent material capable of emitting light visible by the human eye;

a lengthwise rear panel disposed adjacent to and behind the front panel;

a frame attached to both the front panel and the rear panel, the front panel, rear panel, and frame together defining a housing; and a light source within the housing and positioned adjacent the at least one photo-luminescent member such that the light source may be used to energize at least a portion of the photo-luminescent member;

the photo-luminescent member when energized is seen at least 100 feet away from the sign for at least 90 minutes without the use of electricity.

20. The photo-luminescent sign of claim 19, wherein the photo-luminescent material has a particle size of equal to or less than about 40 microns.

* * * * *